United States Patent [19]

Giannesi

[11] Patent Number: 4,812,390

[45] Date of Patent: Mar. 14, 1989

[54] PROCESS AND ELEMENT FOR OBTAINING A PHOTOGRAPHIC IMAGE

[75] Inventor: Pier G. Giannesi, Livorno, Italy

[73] Assignee: Minnesota Mining and Manufacturing Company, St. Paul, Minn.

[21] Appl. No.: 115,760

[22] Filed: Oct. 30, 1987

[30] Foreign Application Priority Data

Nov. 13, 1986 [IT] Italy ..... 22323 A/86

[51] Int. Cl.[4] ..... G03C 1/02; G03C 5/24

[52] U.S. Cl. ..... 430/434; 430/425; 430/567; 430/568; 430/905

[58] Field of Search ..... 430/567, 568, 434, 425, 430/905

[56] References Cited

U.S. PATENT DOCUMENTS

| | | | |
|---|---|---|---|
| 3,573,057 | 3/1971 | Stevens et al. | 430/568 |
| 4,229,525 | 10/1980 | Ueda | 430/568 |
| 4,434,226 | 2/1984 | Wilgus et al. | 430/567 |
| 4,659,646 | 4/1987 | Inoue | 430/568 X |
| 4,677,052 | 6/1987 | Inoue | 430/568 |
| 4,686,176 | 8/1987 | Yagi et al. | 430/567 X |
| 4,692,401 | 9/1987 | House | 430/567 X |
| 4,693,964 | 9/1987 | Daubendiek et al. | 430/568 X |
| 4,727,016 | 2/1988 | Bando | 430/567 |

FOREIGN PATENT DOCUMENTS 1139062 1/1969 United Kingdom .

*Primary Examiner*—Mukund J. Shah

*Attorney, Agent, or Firm*—Donald M. Sell; Walter N. Kirn; Mark A. Litman

[57] ABSTRACT

A photographic image is formed with silver halide emulsions by using optically unsensitized light sensitive (coarse) silver halide grains. Optically (or spectrally) sensitized fine grains (or crystals or particles),—especially light insensitive or Lippmann silver halide grains—, can be reactively associated with optically (or spectrally) unsensitized light sensitive (coarse) silver halide grains to get a combination of Spectrally Sensitized Fine Grains with Spectrally Unsensitized Light Sensitive or Coarse Grains, —especially Tabular Grains—, which can be imagewise exposed (to the light absorbed by the dye sensitizer adsorbed on the surface of such fine grains) and developed with substantially the same sensitivity of the light sensitive optically sensitized (coarse) silver halide grains.

16 Claims, No Drawings

PROCESS AND ELEMENT FOR OBTAINING A PHOTOGRAPHIC IMAGE

FIELD OF THE INVENTION

This invention relates to a process for obtaining a photographic image. The invention relates more specifically to a process for obtaining a photographic image (1) by exposure of a silver halide element to a wavelength of light to which silver halide is not intrinsically sensitive and, (2) development of the exposed element.

BACKGROUND OF THE INVENTION

Photographic images can be produced by imagewise exposing a photographic element comprising light sensitive emulsion layers capable of producing a developable latent image, said emulsions including silver halide grains dispersed therein. Light sensitive silver halide grains have, in general, a significant intrinsic sensitivity only to ultraviolet, violet and blue portion of the electromagnetic spectrum while the human eye is sensitive to the portion which lies approximately between 400 and 750 nm (the visible spectrum). To extend photographic sensitivity to wavelenghts longer than those naturally absorbed by silver halides, that is to the green and/or the red portions of the visible spectrum, and thereby to better approximate the image seen by the human eye, it is normal practice in conventional photography to add optical (or spectral) sensitizing dyes to the silver halide emulsions. These dyes are adsorbed on the surface of silver halide grains and render them sensitive to light absorbed by the dye. In other than conventional photography, optical sensitization is also used to extend the sensitivity of the silver halide grains to other than the visible spectrum such as infrared.

Optical (or spectral) sensitization is distinguished in the art from chemical sensitization which consists of adding silver halide grains with chemical substances which are capable of forming intrinsic sensitivity centers. Optical sensitization consists of having the surface of a silver halide grain adsorbed with a sufficient quantity (well-known in the art) of optical sensitizer dye which absorbs the light of certain wavelengths and transfers the absorbed energy to the same silver halide grain (or crystal) which adsorbed the dye. It is believed that the energy absorbed by the dye is transmitted by the dye to the same dye-adsorbing silver halide grain in the form of electrons or different energy which can be captured by the sensitivity centers of the grain to form specks of latent image. It is believed that grains of the highest sensitivity from modern emulsions need to absorb at least four photons to be rendered developable. In turn this indicates that the minimum size of a developable latent image speck is about four silver atoms (see G.C. Farnell and J.B. Chanter, The Quantum Sensitivity of Photographic Emulsion Grains, Journal of Photographic Science, Vol. 9, 73–83, 1961).

From the above, it is clear why the speed or (sensitivity) of the silver halide emulsions is normally directly related to the size of their silver halide crystals: the larger the size, the higher the probability of absorbing the at least four photons which are necessary for a single crystal to become developable (also in low exposure conditions) upon formation of a developable latent image speck.

As a matter of fact,recent developments in high speed photography make use of coarse optically sensitized silver halide crystals, including thick and thin tabular crystals, which have the characteristic of being capable of offering the maximum capture surface per weight unit of silver. Particularly, in the case of tabular crystals, said crystals need to have adsorbed great quantities of sensitizer dye to be capable of absorbing the photons which impinge on their large (but transparent) capture surface.

Fine silver halide emulsions, such as those normally known in the art as Lippmann emulsions, have not played a significant role in high sensitivity photography, although they can be optically sensitized, as known in the art. These fine grain silver halide emulsions have been recently used in association with coarse silver halide grains to absorb undesired chemical compounds or moieties which are released during the development of such coarse grains. As a matter of fact, the dimensions of the grains of such fine grain emulsions are such that they would not form an image upon exposure and development as used in conventional photography such as, for example, x-ray and color photography. In this sense, we may refer to such fine silver halide emulsions and grains as light insensitive silver halide emulsions and grains as opposed to the light sensitive silver halide emulsions and grains (including tabular grains) which are used in conventional photography to obtain x-ray and color images (the above "light insensitive" and "light sensitive" language will be used hereinafter and further specified).

The process for forming a photographic image in modern low silver photography makes use of optically sensitized light sensitive silver halide grains, preferably thin (or high aspect ratio) tabular grains. These grains are exposed and then developed to form images upon reduction of silver ions to metallic silver. If the reduction is made with a hydroquinone developer, a black and white image is formed and, if the reduction is made with a p-phenylene diamine developer in the presence of a color former (coupler), a colored image is formed.

As known in the art, the silver halide grain, to be optically sensitized (that is, made capable of absorbing exposing light), has to adsorb on its surface the sensitizer dye. Since, however, silver halide emulsions are added with further substances, —such as antifoggants, stabilizers, development accelerators, toner agents, antihalation and acutance dyes, which are adsorbed on the surface of the silver halide grain—, optical sensitization may be negatively affected by displacement of the sensitizer dye by such substances. On the other hand, the presence of sensitizer dye molecules adsorbed on the surface of one silver halide crystal may negatively affect the photographic properties (other than optical sensitivity) of the silver halide crystal by negatively affecting proper adsorption of proper agents on the same surface of the considered crystal.

SUMMARY OF THE INVENTION

The problem solved according to the present invention is that of forming a photographic image with silver halide emulsions by using optically unsensitized light sensitive (coarse) silver halide grains. It has been found in fact that optically (or spectrally) sensitized fine grains (or crystals or particles), —especially light insensitive or Lippmann silver halide grains—, can be reactively associated with optically (or spectrally) unsensitized light sensitive (coarse) silver halide grains to get a combination of Spectrally Sensitized Fine Grains with Spectrally Unsensitized Light Sensitive or Coarse Grains, —especially Tabular Grains—, which can be imagewise exposed (to the light absorbed by the dye sensitizer adsorbed on the surface of such fine grains) and developed with substantially the same sensitivity as with light sensitive optically sensitized (coarse) silver halide grains.

In the specific case of Lippmann and tabular grains, an emulsion including the combination of the present invention can be described as (Spectrally Unsensitized Tabular —Spectrally Sensitized Lippmann) Combined Grain emulsion or (SUT-SSL)CG emulsion with a clear meaning of the acronym and of the letters which compose it.

DETAILED DESCRIPTION OF THE INVENTION

In one aspect, the present invention refers to a process for obtaining a photographic image upon exposure and development of a silver halide grain emulsion, characterized by the fact of including exposure of optically (or spectrally) sensitized fine grains (or crystals or particles), —preferably light insensitive or Lippmann silver halide grains—, and development of optically (or spectrally) unsensitized light sensitive, —specifically, and preferably, tabular, more preferably high aspect ratio or thin tabular) silver halide grains associated with such fine grains before exposure.

In a further aspect, the present invention refers to a process for obtaining a photographic image upon exposure and development of a silver halide emulsion, characterized by the fact that such emulsion includes optically sensitized Lippmann silver halide grains in association with optically unsensitized light sensitive silver halide grains, preferably tabular grains, more preferably high aspect ratio tabular grains.

In another aspect, the present invention relates to a photographic element comprising a layer which includes optically unsensitized light sensitive silver halide grains reactively associated with optically sensitized Lippmann silver halide grains dispersed in a colloidal water permeable layer, preferably a gelatin layer.

In particular, according to the present invention, the advantages associated with the great surface of the fine grains in adsorbing a great quantity of sensitizing dye and the advantages associated with the high developability of the silver halide tabular grain emulsion are obtained at the same time if such fine grain emulsion is adsorbed with a dye sensitizer and is reactively associated with an optically unsensitized silver halide tabular grain emulsion, the combined emulsion being exposed for further development.

To fully understand the unique characteristics of the present invention it will be sufficient to properly consider the fact that the fine silver halide grains, as used within the present invention, are not to be light sensitive, their main function being believed to be that of constituing a surface carrier for the dye to be adsorbed thereto in an aggregated state forming a J-band as known in the art. It can be now conceived to use fine crystals or particles other than silver halide grains such as fine silica crystals or polymeric particles to adsorb the dye sensitizer to be associated with the silver halide to the purposes of the present invention with the proviso that the dye sensitizer adsorbed thereto can form a J-band (in the prior art, as described in U.S. Pat. No. 3,649,286 and Research Disclosure 2402, Apr. 1984, silica is used as a support for the dye to diffuse on to the surface of the silver halide to be optically sensitized by adsorption of the dye itself).

As already indicated, the same silver halide crystal was used in the art as both the center of intrinsic sensitivity to form a latent image for further development and the seat of optical sensitization for the capture of exposing light. According to the present invention, coarse (light sensitive) crystals are used as centers of intrinsic sensitivity and developability while fine (light insensitive) particles are used as seats of optical sensitization and capture of the light (or, better, aggregation of sensitizer dye to form J-band as known in the art). The expression "coarse grain" or "coarse silver halide grain" or "coarse silver halide emulsion" are used herein to indicate any conventional medium size or coarse silver halide grain or emulsion which is "light sensitive" in the sense above indicated. Preferably, said light insensitive fine grains (or crystals or particles) and said light sensitive silver halide grains are dispersed in the same layer within the photographic element which is used in the present invention in a way as to favour a reactive association of such light sensitive silver halide grains with said light insensitive fine grains adsorbed with sensitizer dye molecules without the dye being substantially allowed to diffuse from said fine grains to said light sensitive silver halide grains. Such fine silver halide grains are adsorbed with such a quantity of dye and are present in such a number and size as to form a sufficient absorption barrier (with respect to the desired sensitivity) against the exposing photons and such silver halide coarse particles are present in sufficient quantity as to give the combination the desired developability with respect to the light quantity absorbed by said absorption barrier. From the above, it is clear that the man skilled in the art, to obtain the desired results, can adjust properties by variations both on the quantity of said fine and coarse grains and on the ratio thereof. Of course, the higher the number of fine grains, the higher the quantity of dye which can be adsorbed on their surface. The smaller the grains, the higher the quantity of adsorbable dye per weight unit. With respect to the weight to weight ratio of fine grains to coarse grains, we can say that useful results can be obtained by using 5 to 90 , preferably 20 to 80 and more preferably 30 to 70 percent, by weight of silver of fine grains as related to the total weight of silver including both the fine and coarse grains of the combination of the present invention. We can also say that the dye sensitizer can be used in various quantities relative to the quantity of fine silver halide grains such as, for example, 30 to 3000, preferably 100 to 1500, mg per mole of silver (the quantity should preferably be optimized in a way as to have J-band formation in substantially all of fine grains adsorbed with sensitizer dye).

The quantity of the coarse silver halide grains per square meter of coated material are determined with reference to the maximum density which is needed to obtain the desired black and white or color images, which is usually a maximum density of at least 1.0 for each color or the final black and white image, and more preferably at least 1.5. 30 to 70 percent or preferably 40 to 60 (by weight) percent of the quantity of the same coarse silver halide grains used to get similar desired results with conventional photographic processes can be taken as reference values for the present invention. Of course different quantities of coarse, specifically tabular, grains can be used as well as different ratios of fine grains related to such coarse grains or different ratios of dye to fine grain. The exact values depend upon the nature of the used material in both said fine (silver halide or other than silver halide) and coarse (silver halide) grains, as well as upon the nature of the dye (which can form the desired J-band in higher or lower concentrations depending upon its own nature and the nature of adsorbing surface) used with reference to the type of exposure and development. For example, in the case of X-ray films for medical radiography, the color of the images is generally desired to be bluish black and white, the blue color being obtained by inclusion of proper anthraquinone dyes in the (polyester) support base. The obtaining of a coloration of the images other than the desired one, as per above, due to residual dye sensitizer (colored for example in magenta to absorb the green light) would require, as a remedy, lower amounts of dye sensitizer per weight unit of fine silver halide crystals or lower amounts of optically sensitized fine crystals relative to the coarse silver halide crystals. The use of optically unsensitized fine (light insensitive) crystals with the combined grain emulsion of the present invention may be useful to avoid the formation of such residual stain as known in the art (see U.S. Pat. No. 4,520,098) wherein such fine, optically unsensitized grains are used in the same layer or in a layer different from the one including the optically sensitized emulsion.

As indicated, the combined silver halide emulsion of the present invention includes fine silver halide grains which would not form, per se, any significant image upon exposure and development in standard conditions as respectively used in medical diagnostic radiography (such as with 3M Trimax TM radiographic films processed in standard 3M XAD/2 Developer and 3M XAF/2 fixer) and in color print photography (such as with 3M Scotch TM Color Print 100 ASA processed in a standard C41 type Process). Preferably, such fine grains are not chemically ripened and have an average grain size in the range of 0.01 to less than 0.2 micron, preferably in the range of 0.02 to 0.1 micron. The useful silver halide can be one of among silver chloride, silver bromide, silver iodide, silver bromo-iodide, silver chloro-bromide, silver chloro-bromo-iodide used alone or in combinations of two or more of them. Such fine (Lippmann) grain silver halide emulsions can be prepared and adsorbed with sensitizer dyes with methods well known in the art such as those described in British Pat. No. 1,139,062 and in U.S. Pat. Nos. 3,573,057, 3,705,038, 3,706,566, 3,706,570 and 3,736,145. Of course, the use of sensitizer dye adsorbed on the surface of fine light insensitive grains is herein made not to photographically develop such fine grains but to photographically develop optically unsensitized coarse grains reactively associated therewith in a way as to enable the process for obtaining an image of the present invention.

Accordingly, such fine grains are adsorbed with known sensitizer dyes or combinations of dyes to get the desired sensitivity effects, preferably including J-band formation. The present invention really offers the possibility of having a first portion of such fine grains adsorbed with certain dye sensitizers and a further portion (being the same or different in chemical nature and/or size) of said grains adsorbed with other dye sensitizers different in chemical nature and/or in color, said plurality of portions of optically sensitized fine silver halide grains being used in combination with a coarse silver halide emulsion or a mixed coarse grain silver halide emulsion, as already described.

The light insensitive fine grain emulsions as used in the present invention can be optically sensitized with dyes of various classes, which include cyanines, marocyanines, complex cyanines and merocyanines, oxonols, hemioxonols, styryls, merostyryls and streptocyanines to extend the sensitivity of the silver halide photographic materials beyond the natural sensitivity of the silver halide grains, such as to green, red and infrared rays or to improve their natural response to ultraviolet, violet and blue. Cyanines and merocyanines are the preferred dye sensitizers.

The cyanine optical sensitizing dyes comprise two basic heterocyclic nuclei joined by a polymethine chain. Examples of basic heterocyclic nuclei include those derived from oxazolium, thiazolium, selenazolium, benzoxazolium, benzothiazolium, benzoselenazolium, naphthoxazolum, naphthothiazolium, naphthoselenazolium, quinolinium, isoquinolinium, pyridinium, 3H-indolium, pyrilium and imidazopyridazinium quaternary salts, as described for example in H.Mayer, Spectral Sensitization, Focal Press, 1968.

The merocyanine optical sensitizing dyes comprise a basic heterocyclic nucleus of the cyanine dye type and an acidic heterocyclic nucleus joined by a polymethine chain. Examples of acidic heterocyclic nuclei include those derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin3,5-dione, pentane-2,4-dione, alkylsulfonylacetonitrile, malononitrile, isoquinolin-4-one and chroman-2,4-dione, as for example described in H.Mayer, Spectral Sensitization above.

The optical sensitizing dyes may be used alone or in combination adsorbed on a same portion of fine grains. The choise among dyes having different sensitizing maxima and different optical sensitizing curves and the relative proportions of dyes depend upon the desired sensitivity region and the desired spectral sensitivity curve. It is possible, using combination of dyes having different maxima, to obtain a sensitivity curve which is approximately equal to the sum of the curves of the individual dyes. Combination of dyes can be used which results is supersensitization that is an optical sensitization greater than that any concentration of one of the dyes alone or that which would result from the additive effect of the dyes. Said supersensitization can be achieved with selected combination of optical sensitizing dyes or other addenda such as stabilizers, antifoggants, development accelerators, coating aids, brighteners and antistatic agents, as for example described by P.B.Gilman, Photographic Science and Engineering, Vol.18, 1974, pp 418–430.

The chemistry of cyanine and related dyes is illustrated for example by Weissberger and Taylor, Special Topics of Heterocyclic Chemistry, John Wiley and Sons, New York, 1977, Chapter VIII; Venkatamaran, The Chemistry of Synthetic Dyes, Academic Press, New York, 1971, Chapter V and F. M. Hamer, Cyanine Dyes and Related Compounds, John Wiley and Sons, 1964.

The light sensitive silver halide emulsions, —which are used according to the present invention in reactive association with the optically sensitized light insensitive (fine or small) grain silver halide emulsions —, are comprised of a dispersing medium, such as gelatin, and coarse grain silver halides dispersed therein. Said coarse grain silver halide emulsions are known in the art as light sensitive emulsions, the term "light sensitive" referring to their capability upon exposure to the blue light and development to give photographic images. The silver halide grains consist of silver chloride, silver bromide, silver iodide, silver chlorobromide, silver bromoiodide, silver chlorobromoiodide or mixtures thereof. The silver halide grains can be bound by 100, 111 or 110 crystal planes and can be prepared by a variety of techniques, such as single-jet, double-jet, accelerated flow rate and interrupted precipitation techniques as known in the art. The silver halide can have uniform grain size or a broader distribution of the grain sizes. Also, the silver halide average grain sizes range from more than 0.2 to 5 micron, preferably from about 0.5 to 3 micron.

Light sensitive silver halide grains particularly advantageous according to the present invention are tabular silver halide grains. The term "tabular silver halide grains" is herein conventionally used to indicate silver halide grains. having two substantially parallel crystal faces, each of which is substantially larger than any other single crystal face of the grain. As known in the art, tabular silver halide crystals include those having a thickness of less than 0.5 micron, preferably less than 0.3 micron and having an average aspect ratio of at least 8:1 (thick tabular grains) or having (preferably) an average aspect ratio of at least 18:1 (thin tabular grains) and account for at least 35 percent of the total projected area of the light sensitive silver halide grains, preferably for at least 50 percent. As used in the art, the term "aspect ratio" refers to the ratio of the diameter of the grain to his thickness. The term diameter is in turn defined as the diameter of a circle having an area equal to the grain. The term "projected area" is used in the same sense as the terms "projection area" and "projective area" commonly employed in the art. See, for example, James and Higgins, Fundamental of Photographic Theory, Morgan and Morgan, New York, p 15.

Tabular silver halide grains and method for preparing them are described for example by de Cugnac and Chateau, Evolution of the Morphology of Silver Bromide Crystals During Physical Ripening, Science et Industries Photographiques, Vol. 33, No. 2 (1962), pp. 121–125, by Duffin, Photographic Emulsion Chemistry, Focal Press, 1966, pp. 66–72, by Trivelli and Smith, The Effect of Silver Iodide Upon the Structure of Bromo-Iodide Precipitation Series, The Photographic Journal, Vol. LXXX, July 1940, pp. 285–288, by Gutoff, Nucleation and Growth rates During the Precipitation of Silver Halide Photographic Emulsions, Photographic Science and Engineering, Vol. 14, No. 4, July-August 1970, pp. 248–257, in U.S. Pat. Nos. 4,046,951 4,067,739, 4,150,994, 4,184,877, 4,184,878, 4,386,156, 4,399,215, 4,434,226 and in French Patent Application No. 2,534,036.

As already indicated, the light sensitive or coarse grain silver halide emulsions of the present invention are preferably chemically sensitized. Preferred chemical sensitization methods include the gold sensitization method as described in U.S. Pat. Nos. 2,399,083, 3,597,865 and 2,597,915, the reduction sensitization method as described in U.S. Pat. Nos.2,487,850 and 2,521,925, the sulfur sensitization method as described in U.S. Pat. Nos. 1,623,499 and 2,410,689, the sensitization method using metal ions other than silver as described in U.S. Pat. Nos. 2,566,263 and 2,566,245 or combinations of these methods.

In general, the light sensitive coarse grain silver halide emulsions in the present invention are not optically sensitized. However, even if not preferred within the present invention, said emulsions can have adsorbed on the surface of the coarse grains minor quantities of optical sensitizing dyes. The term "minor quantities" is herein used to indicate quantities of optical sensitizing dyes suitable to obtain less than 40 percent of the maximum photographic sensitivity obtainable with the same light sensitive coarse grain silver halide emulsions when they are optimally optically sensitized.

According to the present invention, the light sensitive coarse grain silver halide emulsions and the light insensitive optically sensitized fine grain silver halide emulsions are reactively associated to form an image recording layer (which includes the developable latent image which has been formed upon exposure) of the photographic element. The term "reactively associated", as defined herein, practically means that the two emulsions are placed in reciprocal proximity by blending them in the image recording layer coating composition in a way as not to cause any substantial transfer (migration) of the sensitizer dye from the fine grains to the coarse grains. Blending can be made at any stage of the preparation of the photographic element following the preparation of the two emulsions, but is preferably delayed until just before coating. According to the present invention, in fact, it has been found that, to attain the best results of the present invention, the contact times of the two emulsions in the image recording layer forming composition are preferably less than 10 minutes, higher times of contact giving a decrease in spectral sensitivity. Particularly, blending can be advantageously made by adding the light insensitive optically sensitized fine grain silver halide emulsion to the coating composition comprising the light sensitive optically unsensitized coarse grain silver halide emulsion just during the coating of the image recording layer.

According to the present invention, it has been found that substantially no migration of optical sensitizing dyes occurs from the fine light insensitive silver halide grains to the coarse light sensitive silver halide grains with contact times before coating of less than 60 minutes, preferably less than 30 minutes and more preferably less than 10 minutes. The two silver halide emulsions in reactive association, the former optically sensitized and the latter optically unsensitized, can form an image recording element which upon light exposure and development can produce a photographic image, even if each emulsion taken alone could not substantially produce any significant image upon exposure (to the light absorbed by the dye) and development.

The image recording emulsion layers of the present invention include as dispersing media (vehicles, peptizers or binders) those commonly used in the photographic art. Preferably the dispersing media are hydrophilic colloids such as proteins, cellulose derivatives, gelatin (e.g. alkali-treated and acid-treated gelatin), gelatin derivatives (e.g. acetylated gelatin, phthalated gelatin and the like) and polysaccharides (e.g. dextran, casein, pectin and the like). Said dispersing media can be used alone or in combination with synthetic polymeric materials (including hydrophobic materials in form of latices) for use as vehicle extenders. Synthetic polymeric materials commonly employed in combination with the hydrophilic colloids include acrylamide and methacrylamide polymers, polyvinyl alcohols, acrylic and methacrylic acid polymers, polymers of alkyl and sulfoalkyl acrylates and methacrylates and the like.

The dispersing media, including in particular hydrophilic colloids as well as synthetic polymeric materials used in combination therewith, can be employed not only in the image recording emulsion layer according to the present invention but also in other layers of the photographic element including said image recording emulsion layer, such as other image recording emulsion layers ( in the case that the photographic element comprises a plurality of image recording emulsion layers and not all include fine and coarse grain silver halide emulsions according to this invention), protective layers, interlayers and layers positioned under said image recording emulsion layers.

The photographic elements of the present invention can conventionally contain, in their image recording emulsion layers or in their other layers optical brighteners, antifoggant, stabilizers, hardeners, scattering and absorbing materials, coating aids, plasticizers, lubricants and matting agents as described in Research Disclosure, Item 17643, cited above, Chapters V, VI, VII, X, XI, XII and XVI, using methods of addition and coating and drying procedures described in Chapters XIV and XV and photographic supports as described in Chapter XVII. The present invention gives the opportunity of not significantly having these photographic adjuvants interfering with dye adsorption if fine optically sensitized grains are used as the last or one of the last coating aids.

The photographic elements including at least one image recording emulsion layer according to the present invention can be used in photographic applications where a stable silver image is produced upon radiation exposure and development, e.g. conventional black-and-white photography and radiography.

In a preferred form, the photographic elements of this invention are radiographic elements. In their simplest form said radiographic elements comprise a single image recording emulsion layer containing the combined fine and coarse grain silver halide emulsions according to this invention coated on one side of a transparent photographic support. In their preferred form said radiographic elements comprise two image recording emulsion layers, at least one being constructed according to this invention, coated on both opposite sides of the support base. Preferably, said transparent supports are polyester film supports, such as polyethyleneterephthalate film supports. Usually, as anticipated, said radiographic elements are blue tinted, for example by adding blue dyes, generally blue anthraquinone dyes, to the molten polyester prior to extrusion. Film supports and tinting dyes for use in radiographic elements are disclosed by Research Disclosure 18431, August 1979, Chapter XII. The radiographic elements can specifically include antikinking agents, stabilizers, antispots, covering power agents, antistatic agents/layers, overcoat layers, etc., as disclosed by Research Disclosure 18431, cited above, Chapters II, III, IV, V, VII and VIII. Radiographic materials are designed for exposure by direct X-rays or preferably by light emitted by phosphor containing intensifying screens. The intensifying screens emitt light in the ultraviolet, blue, green or red portions of the spectrum depending upon the specific phosphors incorporated therein. In order to utilize efficiently the photographic sensitivity of the light sensitive silver halide emulsions incorporated in the radiographic element, the fine silver halide emulsions are optically sensitized to the wavelength region of the light emitted by the intensifying screens. Preferred optical sensitizing dyes are chosen to exibit an absorption peak in their adsorbed state, usually in the H or J band, preferably in the J band, said absorption peak being in a region of the electromagnetic spectrum to which the element is imagewise exposed. Conventional X/ray screens/phosphors and optical sensitizing dyes are disclosed by Research Disclosure 18431, cited above, Chapters IX and X.

The photographic elements according the present invention can also be color photographic elements which form dye images through imagewise destruction, formation or physical removal of dyes. In a preferred form the color photographic elements are those forming dye images through imagewise formation of dyes, such as by reacting a p-phenylendiamine color developing agent in its oxidized form with a dye forming coupler. The dye forming couplers, which can be incorporated in the photographic element or in developers, are chosen to form yellow, magenta or cyan dye images and are two or four equivalent couplers of the open chain ketomethylene, pyrazolone, pyrazolotriazole, phenol and naphthol type. Color photographic materials and their components are disclosed by Research Disclosure 17643, cited above, Chapter VII.

The photographic elements of the present invention can be imagewise exposed in any conventional manner. Imagewise exposure is in particular described by Research Disclosure 17643, cited above, Chapter XVII.

To obtain a visible image the photographic elements are processed in conventional manner following exposure by associating the silver halides with an aqueous alkaline medium in the presence of a developing agent contained in the madium or in the element. Methods of processing, developing agents and other ingredients and steps of the processing are disclosed by Research Disclosure 17643, cited above, Chapters XIX, XX, XXI, XXII, XXIII, XXIV, XXV, XXVI and XXVII.

The present invention is further illustrated by the following examples.

Lippmann Emulsion Preparation

Emulsion L1

The following solutions were prepared.

| Sol. I (in the kettle) at 35° C.: | |
|---|---|
| water | 15,000 ml |
| gelatin | 350 g |
| KBr 0.1 N | 7.5 ml |

having $5\times10^{-5}$ mole/liter of KBr.

| Sol. II at 20° C.: | |
|---|---|
| water | 6,000 ml |
| KBr | 142.8 g |
| carbamoylated gelatin | 120 g |

having 0.2 mole/liter of KBr.

| Sol. III at 20° C.: | |
|---|---|
| water | 6,000 ml |
| $AgNO_3$ | 204 g |

having 0.2 mole/liter of AgNO3. Solutions II and III were added to solution I in the kettle at a constant flow of 125 ml/min and at a constant pAg of 7.6. After precipitation the emulsion was concentrated by ultrafiltration (using a Millipore TM module of 0.95 $m^2$ having a MW 100,000 cut-off membrane) until a conducibility of 850 micros/cm, a Ag % of 1.91 and a gelatin % of 4.8 were obtained. The average grain size of the AgBr emulsion L1 resulted of 0.072 micron.

Emulsions L2 to L7

Following the procedure above emulsions L2 to L7 were prepared. The following table 1 reports (A1) the composition of the silver halide emulsion, (A2) the value of mole/liter of KBr or KI in the kettle, (A3) the value of mole/liter of soluble halides and $AgNO_3$, (A4) the value of Ag %, (A5) the value of gelatin % and (A6) the value of

TABLE 1

| | A1 | A2 | A3 | A4 | A5 | A6 |
|---|---|---|---|---|---|---|
| L2 | AgBr | $5 \times 10^{-5}$ | 1.60 | 7.13 | 9.5 | 0.074 |
| L3 | AgI | " | 0.20 | 1.01 | 4.0 | 0.022 |
| L4 | $AgBr_{98}I_2$ | " | 0.20 | 1.56 | 5.8 | 0.077 |
| L5 | $AgBr_{98}I_2$ | " | 0.40 | 5.39 | 6.4 | 0.060 |
| L6 | $AgBr_{98}I_2$ | " | 1.00 | 6.65 | 4.9 | 0.057 |
| L7 | $AgBr_{90}I_{10}$ | " | 0.20 | 1.92 | 7.1 | 0.063 |

Tabular Emulsion Preparation

Emulsion T1

An AgBr emulsion (Emulsion T1) comprising tabular crystals (having average grain size of 1.01 micron and an aspect ratio of 39:1 whose projected area was 85.4% of the total projective area of the crystals) was prepared with an alternated single jet emulsification process as follows.

The following solutions were prepared.

| | |
|---|---|
| Sol. I (in the kettle) at 45° C.: | |
| water | 2,000 ml |
| KBr | 47.6 g |
| gelatin | 40 g |
| $H_2SO_4$ 1N to a pH of | 4.0 |
| pBr | 0.7 |
| Sol. II: | |
| water | 50 ml |
| KBr | 5.95 g |
| gelatin | 1.71 g |
| Sol. III: | |
| water | 50 ml |
| $AgNO_3$ | 8.5 g |
| Sol. IV: | |
| water | 450 ml |
| KBr | 113.05 g |
| Sol. V: | |
| water | 450 ml |
| $AgNO_3$ | 161.5 g |

Solution III was poured into solution I (in the kettle) in 9 min and Solution II was then poured into Solution I in 1 min. Then 1/9 of Solution V was poured into Solution I in 9 min (5.5 ml/min) and finally 1/9 of the Solution IV was poured into Solution I in 1 min (50 ml/min). Alternated additions of 1/9 portions of Solutions V and IV were repeated until Solutions V and IV were used completely. The emulsion was then coagulated and washed.

Emulsion T2

An AgBrI emulsion (Emulsion T2) containing 1.5 mole percent iodide and comprising tabular crystals having average grain size of 1.2 micron, an aspect ratio of 26:1 and whose projected area was 63 percent of the total projective area of the crystals, was prepared according the process described in example 7 of GB No. 2,210,402.

Emulsion T3

An AgBrI emulsion (Emulsion T3) containing 2.5 mole percent iodide and comprising tabular crystals having average grain size of 1.04 micron, an aspect ratio of 27:1 and whose projected area was 45 percent of the total projective area of the crystals, was prepared according the process described in example 7 of GB No. 2,210,402.

Chemical Sensitization of Tabular emulsions

Each of the tabular emulsions T1, T2 and T3 at 40° C., pH 6.8 and pAg 8.75 was added with 0.377g / Ag mole of Leucophor TM BCF Sandoz and digested 5 minutes at 40° C. The emulsion were each added with 6.97 g/Ag mole of sodium p-toluenesulfinate, 0.013 g/Ag mole of sodium thiosulfate, 0.007 g/Ag mole of gold trichloride, 0.45 g/Ag mole of potassium thiocyanate, 0.008 g/Ag mole of potassium chloropalladite and digested 70 minutes at 40° C. Each emulsion was then added with 1.184 g/Ag mole of 4-hydroxy-6-methyl-1,3,3a,7-tetrazaindene.

EXAMPLE 1

Each of L1 and L4 emulsions (films 1 to 8) were added with different amounts of the green spectral sensitizer anhydrous-5-chloro-9-ethyl-5'-phenyl-3'-(3-sulfobutyl)-3-(3-sulfopropyl)oxacarbocyanine hydroxyde, sodium salt (hereinafter referred to as Dye I). After a pause of 30 min at 36° C each emulsion was added with different amounts of T1 emulsion and kept at 36° C. for 60 min. Each blend of spectrally sensitized Lippmann emulsion and, spectrally unsensitized tabular emulsion was added with an oily dispersion of the magenta dye forming coupler 1-(2',4',6'-trichlorophenyl)-3-(3''-(2''',4'''-ditert.-amylphenoxyacetamido)-benzamido)-5-pyrazolone and coated on a cellulose triacetate support base at a silver coverage of 1 g/$m^2$ and a coupler coverage of 0.75 g/$m^2$. Each emulsion layer was overcoated with an hardener containing gelatin layer at a gelatin coverage of 1.3 g/$m^2$.

As a comparison, emulsion T1 above (film 9) and an octahedral $AgBr_{88}Cl_5I_7$ emulsion (film 10) having an average grain size of 0.35 micron were each spectrally sensitized with Dye I and coated at the same silver coverage and overcoated with the same overcoat layer as emulsions 1 to 8.

Samples of each of films 1 to 10 were exposed to green light trough a shaded wedge and a W99 Wratten TM filter and processed in a type C41 Process.

The following table 2 indicates (B1) the used Lippmann emulsions, (B2) the amounts of Dye I expressed as mg/mole of silver, (B3) the percentages in weight of T1 emulsion and (B4) the values of sensitivity expressed as logE and calculated as difference versus the sensitivity of T1 emulsion (Film 9), taken as reference.

TABLE 2

| Film | B1 | B2 | B3 | B4 |
|---|---|---|---|---|
| 1 | L1 | 400 | 35 | −1.14 |
| 2 | L1 | 1200 | 35 | −0.42 |
| 3 | L1 | 400 | 75 | >−2.7 |
| 4 | L1 | 1200 | 75 | −1.56 |
| 5 | L4 | 400 | 35 | −1.11 |
| 6 | L4 | 1200 | 35 | −0.24 |
| 7 | L4 | 400 | 75 | >−2.7 |
| 8 | L4 | 1200 | 75 | −1.38 |
| 9 | // | 400 | 100 | 0.00 |
| 10 | // | 400 | 0 | −0.06 |

The green sensitivity of films containing the combined emulsion of the present invention including spectrally sensitized Lippmann emulsions reactively associated with spectral unsensitized tabular emulsion were higher than that of the singly coated component of the blend.

Particularly, the sensitivity was higher when lower Lippmann emulsion concentrations and higher amounts of sensitizing dye are used.

EXAMPLE 2

Emulsion L4 was added with 1200 mg/mole of silver of spectral sensitizing Dye I. After a pause of 30 min at 36° C. different portions of the spectral sensitized L4 emulsion were each added with T1 emulsion in an amount corresponding to 50% by weight of the total silver. Each blend was allowed to stay at 36° C. for different times before being coated at a total silver coverage of 1 g/m$^2$. Samples of the films were exposed and processed as in example 1.

The following table 3 reports (C1) the pause time of each blend, (C2) the sensitivity to green light ad (C3) the sensitivity to blue light.

TABLE 3

| Film | C1 | C2 | C3 |
|---|---|---|---|
| 1 | 5 min | 0.88 | 1.01 |
| 2 | 30 min | 0.71 | 0.76 |
| 3 | 120 min | 0.28 | 0.45 |
| 4 | 360 min | 0.17 | 0.25 |

The experiments show how, to the purposes of obtaining higher speed, the contact time of the components of the combined emulsion is preferably the shortest.

EXAMPLE 3

Four films according to this invention (Films 1 to 4) were obtained by coating compositions obtained by adding a Lippmann emulsion with spectral sensitizing Dye I in an amount of 1200 mg/mole of total coated silver, making a pause of 30 min at 36° C., adding it with T1 emulsion and making a pause of 30 min at 36° C.

A comparison film (film 5) was obtained by coating a composition comprising T1 emulsion spectrally sensitized with spectrally sensitizing Dye I in an amount of 1200 mg/mole of total coated silver.

Samples of the films were exposed and processed as described in example 1.

The following table 4 indicates (D1) the percent by weight of the total silver due to Lippmann emulsion, (D2) the used Lippmann emulsion, (D3) the total silver coverage in g/m$^2$, (D4) the value of D min, (D5) the value of D max, (D6) the sensitivity to green light, (D7) the sensitivity to blue light, (D8) the toe contrast and (D9) the developed silver percentage.

TABLE 4

| Film | D1 | D2 | D3 | D4 | D5 | D6 | D7 | D8 | D9 |
|---|---|---|---|---|---|---|---|---|---|
| 1 | 50 | L2 | 1.90 | .13 | 2.05 | 1.12 | 1.01 | 1.09 | 55 |
| 2 | 50 | L5 | 1.97 | .15 | 2.16 | .73 | .96 | 1.16 | 49 |
| 3 | 50 | L7 | 1.92 | .16 | 1.76 | .64 | .93 | .83 | 41 |
| 4 | 50 | L3 | 1.52 | .17 | 1.46 | 1.20 | 1.12 | .71 | 42 |
| 5 | / | / | 2.07 | .15 | 2.38 | 1.72 | 1.19 | 1.45 | 88 |

Maximum sensitivity within the process of the invention was obtained with the film 4 (having low silver coverage) including L3 emulsion, a spectrally sensitized AgI Lippmann emulsion; a sensitivity slightly lower than with film 4 was obtained with film 1 including L2, a spectrally sensitized AgBr Lippmann emulsion; bromoiodide Lippmann emulsions L5 and L7 gave lower sensitivity to green light while sensitivity to blue light was not significantly lower than obtained with L2 and L3 emulsions. The contrast turns out to be higher with bromoiodide Lippmann emulsions. Percent values of developed silver appear to be lower than with conventional tabular emulsions also in the presence of similar D max values.

EXAMPLE 4

Different portions of emulsion L3 were added with different amounts of spectral sensitizing dye anhydrous-5,5'-dichloro-9-ethyl-3,3'-di(3-sulfopropyl)oxacarbocyanine hydroxide sodium salt (hereinafter referred to as Dye II) and heated at 45° C. for 60 minutes.

Different amounts of spectrally sensitized L3 emulsions were added to different portions of emulsion T2 at the end of chemical sensitization. After a pause of 3 minutes at 50° C. the combination (mixture) of two emulsion was added with the stabilizer 4-hydroxy-6-methyl-1,3,3a,7-tetrazaindene.

Other different amounts of spectrally sensitized L3 emulsion were added to different portions of emulsinn T2 after chemical sensitization and addition of stabilizer and heated at 40° C. for 5 minutes.

Other different amounts of spectrally sensitized L3 emulsion were added to different portions of emulsion T2 after chemical sensitization and addition of the stabilizer and heated at 40° C. for 65 minutes.

Another portion of T2 emulsion was spectrally sensitized with Dye II added during chemical sensitization.

Each emulsion composition was added with a stabilizer, an antifogging agent, a gelatin hardener, coating aids, a plasticizer and a gelatin extender and coated on a transparent polyethyleneterephthalate support base.

Samples of each obtained film were exposed to green light trough a shaded wedge and a W99 Wratten TM filter; other samples were exposed to blue light using a W98 Wratten TM filter. After exposure, the film samples were processed in a 3M XP 507 roller transport processor. Processing consisted of 3M XAD/2 Developer for 24 seconds at 35° C., followed by fixing in 3M XAF/2 Fixer for 24 seconds at 35° C., washing in tap water for 22 seconds at 35° C. and drying for 22 seconds at 35° C.

The following table 5 reports (E1) the mode of addition of spectrally sensitized L3 emulsion to emulsion T2 (wherein A means addition between chemical sensitization and stabilization, B means addition after chemical sensitization and stabilization followed by a pause of 5 minutes before coating and C means addition after chemical sensitization and stabilization followed by a pause of 65 minutes before coating), (E2) amount in grams of emulsion L3 per mole of emulsion T2, (E3) amount in mg of spectral sensitizing Dye II per mole of silver, (E4) total silver coverage in grams, (E5) Dmin, (E6) blue speed, (E7) green speed, (E8) medium contrast and (E9) Dmax:

TABLE 5

| Film | E1 | E2 | E3 | E4 | E5 | E6 | E7 | E8 | E9 |
|---|---|---|---|---|---|---|---|---|---|
| 1 | A | 26.7 | 141 | 1.93 | .21 | 2.21 | 2.40 | 1.36 | 2.16 |
| 2 | A | 53.4 | 282 | 1.99 | .23 | 2.20 | 2.70 | 1.23 | 2.14 |
| 3 | A | 80.1 | 423 | 1.99 | .35 | 2.33 | 3.00 | 1.11 | 2.20 |
| 4 | A | 106.8 | 564 | 1.92 | .33 | 2.31 | 3.02 | 1.06 | 2.20 |
| 5 | B | 26.7 | 141 | 2.00 | .26 | 2.23 | 2.59 | 1.22 | 2.32 |
| 6 | B | 53.4 | 282 | 2.03 | .33 | 2.28 | 2.85 | 1.12 | 2.20 |
| 7 | B | 80.1 | 423 | 1.94 | .38 | 2.37 | 2.97 | 1.08 | 2.27 |
| 8 | B | 106.8 | 564 | 1.98 | .40 | 2.38 | 2.97 | 1.03 | 2.25 |
| 9 | C | 266 | 750 | 1.90 | .21 | .60 | 1.29 | .90 | 1.75 |
| 10 | C | 266 | 975 | 1.87 | .23 | .30 | .99 | 1.00 | 1.73 |
| 11 | C | 266 | 1200 | 1.91 | .23 | .41 | 1.07 | .94 | 1.82 |
| 12 | — | — | 750 | 2.03 | .17 | 2.15 | 2.58 | 1.55 | 2.38 |

These data indicate mode C as the worst mode of addition of Lippmann emulsion to tabular emulsion, B mode being better than A mode.

EXAMPLE 5

Different portions of emulsion L3 were added with different amounts of the spectral sensitizing Dye II and heated at 40° C. for 60 minutes.

Different amounts of the spectrally sensitized L3 emulsion were added to different portions of emulsion T3 at the end of chemical sensitization.

After a pause of 2 minutes at 50° C. the obtained combination emulsions were added with the 4-hydroxy-6-methyl-1,3,3a,7-tetrazaindene stabilizer.

Further different amounts of spectrally sensitized L3 emulsion were added to different portions of emulsion T3 at the end of chemical sensitization and addition of stabilizer. The obtained combination emulsions were then heated at 50° C. for 2 minutes.

Each combination emulsion was added with the same ingredients of example 4 and coated in the same way. Samples of the films obtained were exposed and processed as in example 4 in comparison with a film equivalent to film 12 of example 4.

The following table 6 reports (F1) mode of addition of spectrally sensitized emulsion L3 to emulsion T3 (wherein A means addition of emulsion L3 between chemical sensitization and stabilization of emulsion T3 and B means addition of emulsion L3 to emulsion T3 after chemical sensitization and addition of the stabilizer), (F2) amount in grams of emulsion L3 per mole of emulsion T3, (F3) amount in mg of spectral sensitizer per mole of silver, (F4) total silver coverage, (F5) Dmin, (F6) blue speed, (F7) green speed, (F8) average contrast and (F9) Dmax.

TABLE 6

| Film | F1 | F2 | F3 | F4 | F5 | F6 | F7 | F8 | F9 |
|---|---|---|---|---|---|---|---|---|---|
| 1 | A | 28.4 | 300 | 1.96 | .21 | 2.23 | 2.69 | 1.10 | 2.09 |
| 2 | A | 57.8 | 600 | 1.74 | .26 | 1.96 | 2.72 | .90 | 1.74 |
| 3 | A | 28.4 | 376 | 2.12 | .17 | 2.07 | 2.62 | 1.20 | 2.09 |
| 4 | A | 57.8 | 752 | 1.95 | .22 | 2.00 | 2.74 | 1.00 | 1.94 |
| 5 | B | 28.4 | 300 | 1.87 | .18 | 2.11 | 2.64 | 1.23 | 1.93 |
| 6 | B | 57.8 | 600 | 1.77 | .21 | 2.06 | 2.75 | 1.00 | 1.82 |
| 7 | B | 28.4 | 376 | 1.73 | .17 | 2.04 | 2.62 | 1.11 | 1.74 |
| 8 | B | 57.8 | 752 | 1.80 | .27 | 1.88 | 2.60 | .90 | 1.75 |
| 9 | — | — | 750 | 1.99 | .15 | 2.01 | 2.66 | 1.50 | 2.09 |

EXAMPLE 6

Emulsion L5, comprising dispersed in gelatin one mole of $AgBr_{98}I_2$ grains having average grain size of 0.060 micron, was added with 2400 mg/mole of silver of spectral sensitizing Dye I. After a pause of 30 min. at 36° C., the emulsion was added to Emulsion T1, comprising dispersed in gelatin one mole of spectrally unsensitized tabular AgBr grains. After a pause of 5 min. at 36° C., the blend was diluted with an equal volume of water, put in a test tube and centrifuged at 3,000 rpm. Silver halide grains deposited in the bottom of the test tube were separated from the rest of the supernatant aqueous phase; they resulted at a scanning electron microscope examination tabular crystals with less than 1 percent of their surface presenting small crystals, while at the same examination the blend of the two emulsions before centrifugation presented tabular crystals with more than 50 percent of their surface covered by small crystals.

The crystals deposited in the bottom of the test tube and the crystal presented in the supernatant aqueous phase were separately subjected to methanolic extraction and the methanolic extracts were subjected to spectrophotometric examination in the visible region. A flat spectrophotometric curve with a slight maximum having an absorbance of 0.0281 at 500 nm was obtained for large crystals separated in the bottom of the test tube while a sharp spectrophotometric curve with a maximum having an absorbance of 0.3799 at 500 nm was obtained for small crystals contained in the supernatant aqueous phase of the test tube.

One crystal of the blend spectrally sensitized emulsion L5 and spectrally unsensitized emulsion T1 was examined with an TN-5500 X/ray analyzer of the TRACOR Northern Co. to determine element I and S distribution along a line crossing the surface of the large crystal covered by small crystals (line profile) and the distribution map of elements Br, I and S on the surface of the crystal (element map). It was accertained that S (contained in the chemical formula of the spectral sensitizing Dye I) was present in correspondence of I (contained in the chemical formula of the light insensitive small grains of emulsion L5) and the correspondence of I and S was in that zone of the crystal surface which was covered by fine silver halide crystals.

I claim:

1. A process for obtaining a photographic image upon exposure and development of a silver halide emulsion characterized by exposing light insensitive optically sensitized grains and then developing light sensitive optically unsensitized silver halide grains reactively associated with such light insensitive grains during exposure and development.

2. The process of claim 1 wherein said light sensitive silver halide grains have an average grain size larger than 0.2 micron.

3. The process of claim 1 wherein said light insensitive grains have an average grain size less than 0.2 micron.

4. A photographic element comprising a support base and a silver halide emulsion layer on a surface of said support base, said base including light sensitive optically unsensitized silver halide grains and light insensitive optically sensitized grains in reactive association with each other.

5. The photographic element of claim 4 characterized by said light sensitive silver halide grains being tabular grains.

6. The photographic element of claim 5 wherein said silver halide tabular grains are silver bromide grains or silver bromoiodide grains.

7. The photographic element of claim 5 wherein said tabular grains have an aspect ratio of at least 8:1 and a net projected area value of at least 50 percent and said optically sensitized light insensitive grains are present in an amount of at least 5 percent by weight.

8. The photographic element of claim 4 wherein said light insensitive optically sensitized grains are silver bromide, silver bromoiodide or silver iodide grains.

9. The photographic element of claim 4 characterized by having two opposite light sensitive emulsion layers each coated on one side of said support base at least one of said emulsion layers including said light sensitive optically unsensitized silver halide grains reactively associated with light insensitive optically sensitized grains.

10. A light insensitive silver halide emulsion including silver halide grains dispersed in a hydrophilic colloid binder having adsorbed on their surface a sensitizer dye in reactive association with a optically unsensitized light sensitive silver halide grain emulsion.

11. The process of claim 2 wherein said light insensitive grains have an average grain size less than 0.2 micron.

12. The element of claim 4 wherein said light sensitive optically unsensitized grains have an average diameter of greater than 0.2 microns.

13. The element of claim 4 wherein said light insensitive optically sensitized grains have an average grain size of less than 0.2 microns.

14. The element of claim 2 wherein said light insensitive optically sensitized grains have an average grain size of less than 0.2 microns.

15. The element of claim 12 wherein said unsensitized grains are tabular grains.

16. The element of claim 14 wherein said unsensitized grains are tabular grains.

* * * * *